US005617108A

United States Patent [19]

Silinsky et al.

[11] Patent Number: 5,617,108

[45] Date of Patent: Apr. 1, 1997

[54] SIMPLIFIED TRACKING ANTENNA

[75] Inventors: Robert E. Silinsky, Lakewood; Frank Boldissar, Jr., Redondo Beach; Gary S. Campbell, Torrance; Raghbir S. Tahim, Buena Park, all of Calif.

[73] Assignee: Hughes Electronics, Los Angeles, Calif.

[21] Appl. No.: 489,098

[22] Filed: Jun. 9, 1995

Related U.S. Application Data

[63] Continuation of Ser. No. 215,237, Mar. 21, 1994, abandoned.

[51] Int. Cl.[6] ..... H01Q 13/00

[52] U.S. Cl. ..... 343/786; 333/135

[58] Field of Search ..... 343/786; 333/103, 333/135, 137, 258

[56] References Cited

U.S. PATENT DOCUMENTS

| | | | |
|---|---|---|---|
| 3,731,235 | 5/1973 | Ditullio et al. | 333/135 X |
| 4,473,828 | 9/1984 | Morz et al. | 333/137 X |
| 4,490,700 | 12/1984 | Stern et al. | 333/258 |
| 4,704,611 | 11/1987 | Edwards et al. | 343/786 X |
| 4,843,358 | 6/1989 | Meise et al. | 333/103 X |
| 5,053,732 | 10/1991 | Elgass et al. | 333/258 X |
| 5,359,336 | 10/1994 | Yoshida | 343/786 X |
| 5,374,938 | 12/1994 | Hatazawa et al. | 343/786 X |

OTHER PUBLICATIONS

B.K. Watson and M. Hart, "A primary feed for electronic tracking with circularly-polarised beacons", Conference Proceedings. Military Microwaves '86, 24–26 Jun. 1986, Brighton U.K., pp. 261–266.

N. Dang et al., "Electronic tracking systems for satellite ground stations", 15th European Microwave Conference, Paris, France Sep. 1985, p. 681.

B.K. Watson, N.D. Dang, I. Davis, D. Edwards, A.W. Rudge and E.C. Johnstone, "A New Electronic Tracking System for Fine Pointing of Large Reflectors" 1986 IEEE, pp. 420–424.

D.J. Brain, N.D. Dang, I.M. Davis and D.A. Granville-George, "KA-Band Tracking Antenna for Inter-Orbit Communications" 1989 IEEE, pp. 1606–1609.

*Primary Examiner*—Donald T. Hajec
*Assistant Examiner*—Tho Phan
*Attorney, Agent, or Firm*—Terje Gudmestad; Wanda K. Denson-Low

[57] ABSTRACT

An antenna pointing detection system for use with circularly polarized electromagnetic radiation has a horn, a waveguide and at least one mode switching arm. The horn receives radiation in a primary mode from the radiation source. The waveguide receives radiation from the horn and supports only radiation in a primary mode, e.g. the $TE_{11}$ mode and the next higher order TE mode, e.g. the $TE_{21}$ mode at one or more rectangular mode switching arms extending from the circular waveguide for stimulating radiation of the-next order $TE_{21}$ mode in the waveguide. The arm has a series of switchable pin diodes for changing the effective length of the mode switching arm to cause a phase alteration in the $TE_{21}$ mode thereby causing a deflection of the effective pointing direction of the horn. The magnitude of the received signal is detected and compared with different deflections of the horn to operate conventional antenna pointing hardware.

19 Claims, 5 Drawing Sheets

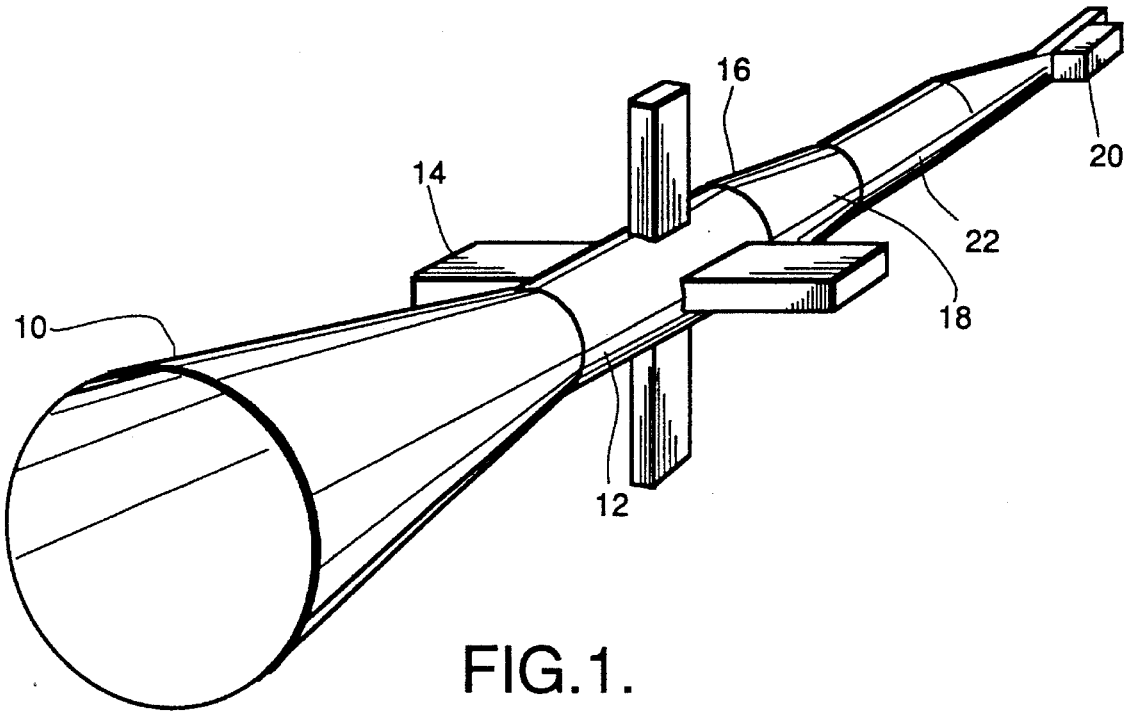
FIG.1.
FIG.2a.
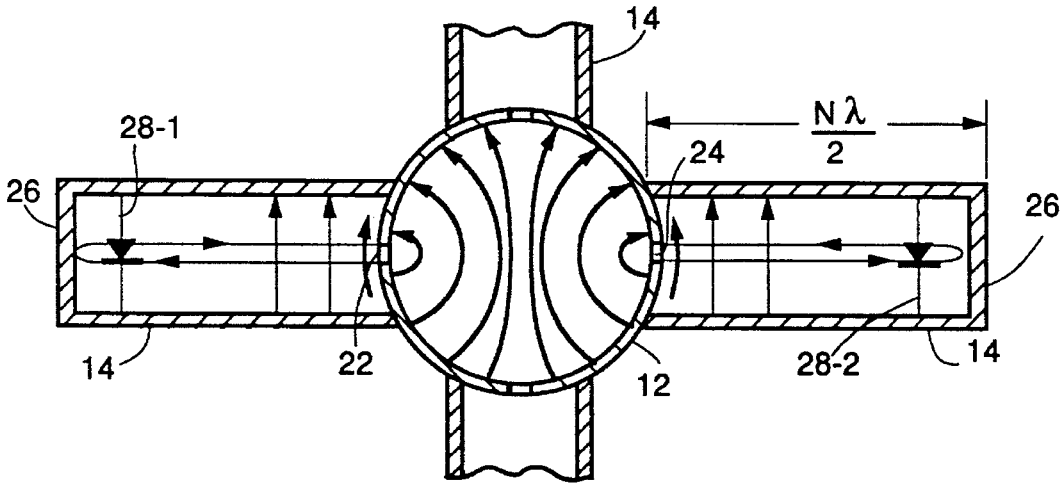

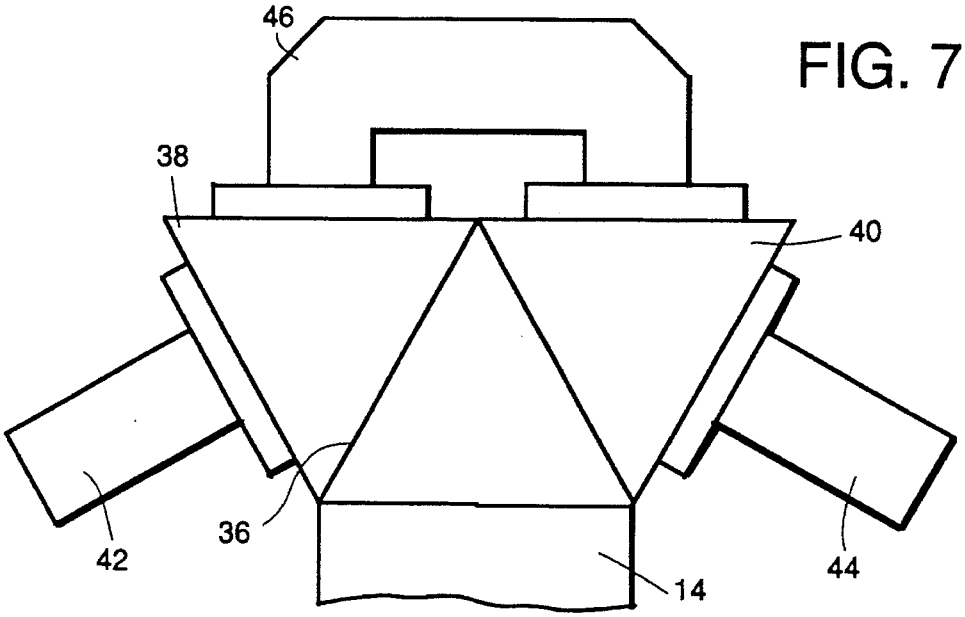
FIG. 7
FIG. 8a.
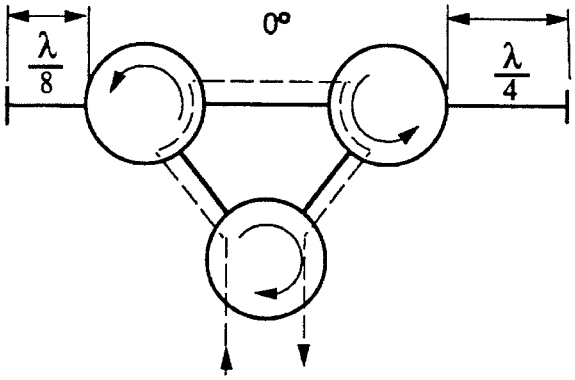
FIG. 8b.
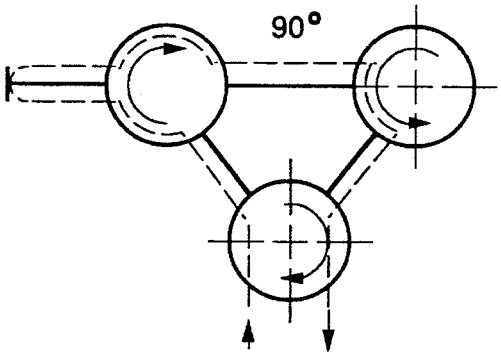
FIG. 8c.
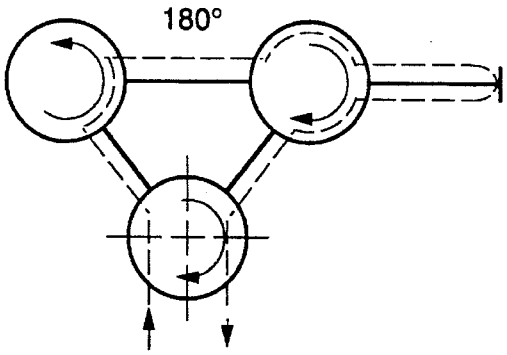
FIG. 8d.
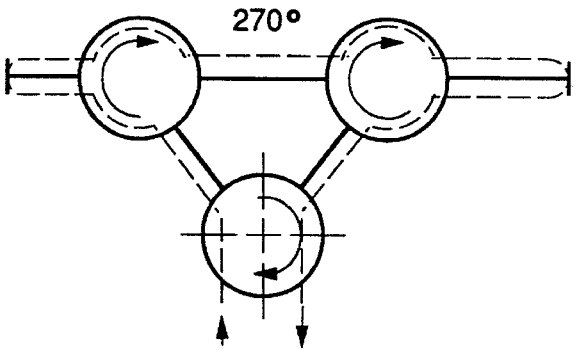

SIMPLIFIED TRACKING ANTENNA

This invention was made with Government support under a contract awarded by the Government. The Government has certain rights in this invention.

CROSS REFERENCE TO RELATED APPLICATION

This application is a continuation of U.S. Patent Application Ser. No. 08/215,237, filed Mar. 21, 1994, now abandoned.

FIELD OF THE INVENTION

The present invention pertains to the field of antenna pointing and signal tracking systems and more particularly to an autotracking feed antenna system using a higher order waveguide mode to deflect an antenna's circularly polarized beam.

BACKGROUND OF THE INVENTION

In many applications, especially satellite communications, it is important to maximize the strength of signals received, for example, by a microwave antenna feed horn. This requires that the antenna be pointed precisely at the incoming beam even though the transmitter may not be stationary. An electronic autotracking antenna provides for autotracking on a received signal, that is, it can be used to develop signals indicating whether or not the antenna's boresight axis is aligned with the direction of the incoming signal wave front beam. To perform this function, the antenna feed is electronically switched to sequentially provide four slightly different beam receiving positions. The direction of arrival of the received signal can be deduced from the relative signal strengths in the four beam directions. This type of action is often called "sequential lobing".

The switching is typically done at a rate of less than 400 Hz which is slow relative to the signal frequencies but fast enough to allow for effectively constant correction of the antenna position. Such a system using two mode switching arms for the $TE_{21}$ mode and two mode switching arms for the $TM_{01}$ mode to "squint" the antenna in four orthogonal directions is well known. Such prior systems require a significant amount of hardware not otherwise required for the data transmission, limit the bandwidth capacity of the antenna and are effective only for one sense of circularly polarized signals.

SUMMARY OF THE INVENTION

The present invention provides a switchable autotracking system for an antenna with greater bandwidth and greatly reduced parts and weight. In one embodiment, the invention encompasses an antenna pointing detection system for use in circularly polarized electromagnetic radiation with a horn for receiving the radiation, a waveguide coupled to the horn and at least one mode switching arm extending from the waveguide. The waveguide supports only radiation in a primary mode and the next order TE mode. The switching arm stimulates only radiation of the next order TE mode in the waveguide and has a switchable plurality of arm lengths for causing a phase alteration in the next order TE mode and thereby causing a deflection of the effective pointing direction of the horn.

In another embodiment, the invention encompasses an antenna pointing detection system for use with circularly polarized electromagnetic radiation having a horn, a waveguide and a mode switching arm. The waveguide is coupled to the horn for receiving radiation received by the horn from the horn. The mode switching arm extends from the waveguide for stimulating radiation of a higher order mode than the primary mode and the waveguide and has a switchable plurality of different effective lengths for causing a phase alteration in the higher order mode radiation. The phase altered higher order mode radiation combines with the primary mode radiation in the waveguide to deflect the effective pointing direction of the horn in at least two substantially orthogonal directions.

BRIEF DESCRIPTION OF THE DRAWINGS

These and other aspects of the invention will be more fully understood with reference to the following detailed description and accompanying drawings wherein:

FIG. 1 is a perspective view of a tracking feed horn antenna with four mode switching arms according to the present invention;

FIG. 2A is a cross sectional view of the waveguide and mode switching arms of the feed horn of FIG. 1 showing the undisturbed state of the $TE_{11}$ mode with electric field direction indicated by curved or straight arrows;

FIG. 7 is a plan view of an alternative switching mode arm using ferrite switches for use with a waveguide according to the present invention;

FIG. 8A is a diagram of a first mode of operation of the arm of FIG. 7;

FIG. 8B is a diagram of a second mode of operation of the arm of FIG. 7;

FIG. 8C is a diagram of a third mode of operation of the arm of FIG. 7;

FIG. 8D is a diagram of a fourth mode of operation of the arm of FIG. 7;

BRIEF DESCRIPTION OF THE INVENTION

Figure 2B:
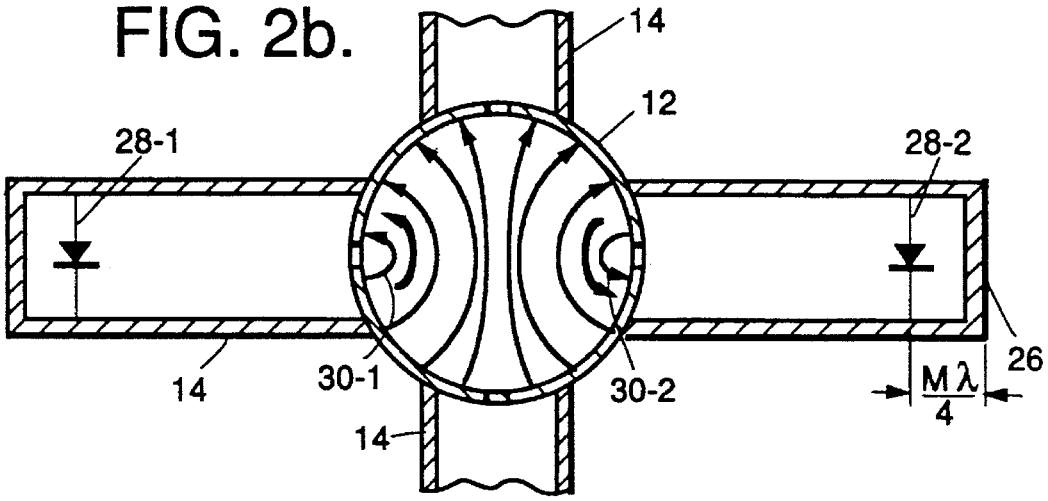
FIG. 2B is a view similar to that of FIG. 2A showing the state of the $TE_{11}$ mode in the waveguide disturbed by asymmetries in the mode switching arms.

The autotracking feed antenna depicted in FIG. 1 is intended for use with circularly polarized electromagnetic radiation preferably in the microwave band, and has a horn 10 for receiving incoming radiation. The horn feeds into a cylindrically shaped circular waveguide section 12 with four radially extending rectangular waveguide arms or mode switching arms 14, which feeds into a mode filter 16 which feeds into a polarizer 18 and an orthomode transducer 20. The latter two elements separate the two senses of circular polarization, left and right, into two different channels. A circular to rectangular transition 22 allows received signals in the two senses to be carried to the associated signal processing equipment through different rectangular waveguides. The four radial arms provide a lobe switching action that produces a slight amplitude modulation of the received signal. This modulation can be used to determine the direction of arrival of the signal with respect to the antenna boresight axis using conventional autotracking methods.

For simplicity, only one component of the circularly polarized wave is considered. This component propagates in the circular waveguide in the lowest order mode possible, namely the $TE_{11}$. It is typically the only mode carrying the data which the antennas are used to communicate, e.g. telephone, television or radio signals. To maximize the antenna gain, the direction of the radiation into the horn should be directly along the axis of the waveguide and horn, i.e. the horn's boresight axis. The mode switching radial arms 14 are used to perturb the effective pointing direction of the horn by inducing higher order modes in the waveguide and the horn. By detecting differences in antenna gain with different perturbations, the horn's boresight-axis can be aligned to precisely track the received signal as is known in the art.

Referring to FIG. 2A, each mode switching arm 14 consists preferably of a shorted elongated rectangular waveguide which is connected to the side wall of the circular waveguide 12 via a coupling hole 22. The elongated arms extend outward and are shorted by electrically conducting walls 26 at their far ends. The length of each arm is nominally an integral number of half wavelengths of the $TE_{01}$ or $TE_{10}$ mode in the rectangular waveguide. Each arm also has a switchable short circuit preferably in the form of a PIN diode 28-1, 28-2 mounted an odd integral number of quarter wavelengths away from the short circuited end. The diodes in the arm act like a conducting wall, when switched on, allowing the effective length of the wall to be modified as is well known in the art. When a diode is switched on, the electrical length of the waveguide is decreased by an odd integral number of quarter wavelengths depending on the position of the diode, resulting in a 180 degree change of phase in the coupled energy.

Using arrows to show electric field directions, FIG(s). 2A and 2B, show the vertically polarized component of a circularly polarized wave. When both diodes are off, as in FIG. 2A, the coupling holes look like short circuits and the basic $TE_{11}$ mode is undisturbed. In FIG. 2B, the right side diode 28-2 is on, reducing the electrical length of the arm. The fields at the coupling holes of the two arms are now different, as shown by the arrows 30-1, 30-2, and an asymmetry is set up, exciting the $TE_{21}$ mode in the circular waveguide. The asymmetry in the $TE_{11}$ mode is caused by the $TE_{21}$ mode combining in the waveguide with the $TE_{11}$ mode. The diameter of the circular waveguide 12 is chosen so that it will support both modes while the switching arms 14 support only the $TE_{01}$ or $TE_{10}$ mode.

Figure 2C:
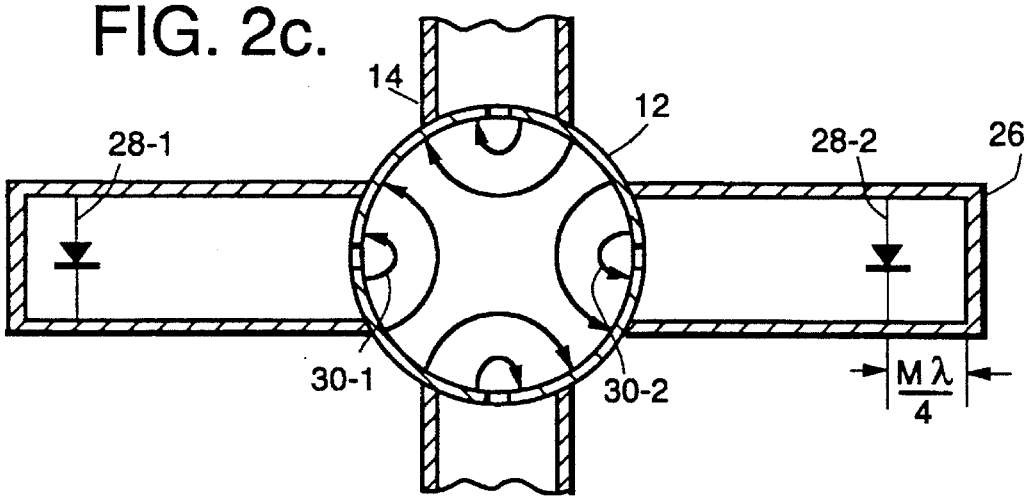
FIG. 2C is a view similar to that of FIG. 2B showing a representation of the asymmetrical $TE_{21}$ mode.

The configuration of the asymmetrical $TE_{21}$ mode is shown in FIG. 2C. The strength of the $TE_{21}$ mode is a small fraction of that of the basic $TE_{11}$ mode, the fraction being determined by the degree of coupling between the circular waveguide and the arms. The sum of the fields in the two modes produces a wavefront which effectively deflects the direction that the horn points for purposes of receiving incoming radiation with respect to the horn's physical axis. The magnitude of the angle is a function of the relative magnitudes of the two modes, and also depends on the degree of coupling between the two modes. Typical coupling levels are in the range of 15 to 30 dB.

The deflection of the wavefronts is in the right-left plane as shown in FIG. 2B. Switching the right diode 28-2 off and the left diode 28-1 on, reverses the direction of deflection. Switching both diodes on restores the symmetrical condition, and no beam deflection occurs.

Figure 3A:
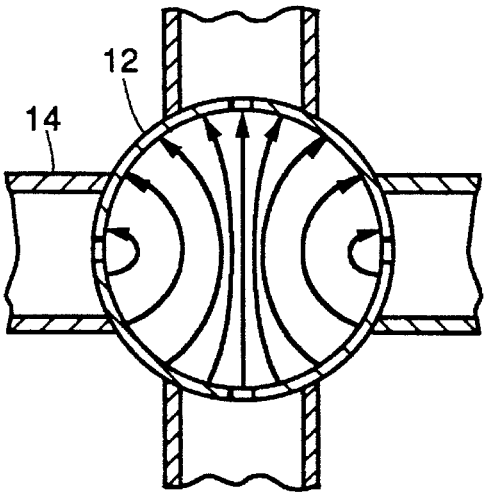
FIG. 3A is a representation of the vertical component of the $TE_{11}$ mode in the waveguide.
Figure 3B:
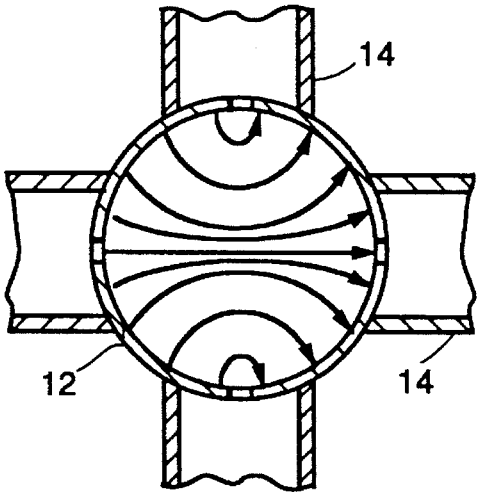
FIG. 3B is a representation of the horizontal component of the $TE_{11}$ mode in the waveguide.

The second component of the circularly polarized wave is at right angles to the first and in phase quadrature with it. As shown in FIG(s) 3A and 3B, the $TE_{11}$ mode of the circularly polarized wave has two components which are orthogonal to one another in phase quadrature. In other words, when the field of the "in-phase" or vertical component is a maximum at the plane of the page in FIG. 3A, the maximum quadrature field or horizontal component for FIG. 3B is a quarter wavelength in front of or behind the plane of the page. Accordingly, the second pair of radial arms, which extend vertically in the drawings, orthogonal to the first pair, can be used, in the same manner as described above, to deflect the beam in the vertical (as shown in FIG. 2B) plane. Note that only one component of the circularly polarized wave is deflected in each plane. That is, the vertical component is deflected in the horizontal plane, and the horizontal component in the vertical plane. Either sense of circular polarization can be tracked, requiring only a sign inversion in the definition of beam direction.

Earlier electronic tracking antennas have used the $TE_{21}$ mode for tracking one component, e.g. the horizontal, and the $TM_{01}$ mode for tracking the other component, e.g. vertical. The two modes are orthogonal to each other and the circular waveguide 12 can easily be constructed to allow the two modes to propagate simultaneously at the desired wavelength. Relying on differences in phase and resonances between the $TM_{01}$ and $TE_{21}$ modes, the corresponding respective pairs of arms are conventionally constructed so that only the $TM_{01}$ mode propagates in one pair of arms and only the $TE_{21}$ mode propagates in the other pair. According to the present invention, it is possible to track both orthogonal components using only the $TE_{21}$ mode. Because of the rotating propagation of circularly polarized wavefronts, the $TE_{21}$ mode can be used for tracking both orthogonal components. One improvement that comes from the adoption of the $TE_{21}$ mode is in the overall bandwidth of the feed. The high end frequencies in a circular waveguide for the $TE_{21}$ and $TE_{11}$ modes are in the ratio of about 1.66, whereas the $TM_{01}$ and $TE_{11}$ differ by a ratio of about 1.31. By building the circular waveguide 12 to accommodate only the $TE_{21}$ and $TE_{11}$ modes a greater range of $TE_{11}$ mode wavelengths can be accommodated. The ratios above define the maximum separation between the tracking beacon in $TE_{21}$ and $TM_{01}$ modes (assumed to be at the high frequency end) and other signals preferably in the $TE_{11}$ mode which may be in the horn.

The feed antenna includes a mode filter 16 implemented, for example, by a change in waveguide diameter which precludes propagation of the $TE_{21}$ mode into the horn past the waveguide and mode switching arms. Use of the $TE_{21}$ as the higher order tracking beacon mode simplifies the design of this filter. Earlier tracking antennas required complex crossband couplers and filters in order to obtain the tracking information, none of which is required when only the $TE_{11}$ and $TE_{21}$ modes are sustained in the circular waveguide 12.

As a result of the phase relationship between the two components of the circularly polarized incoming beam, the planes of beam deflections can also be arbitrarily rotated with respect to the planes of the arms. In other words, two opposing arms each produce a deflection in several different directions. In the above description, these two sets of planes are the same. However, by adjusting the locations of the diodes in the arms so as to provide a phase shift different than 180 degrees when the diode is activated, a rotation of the plane of deflection can be achieved.

Figure 4A:
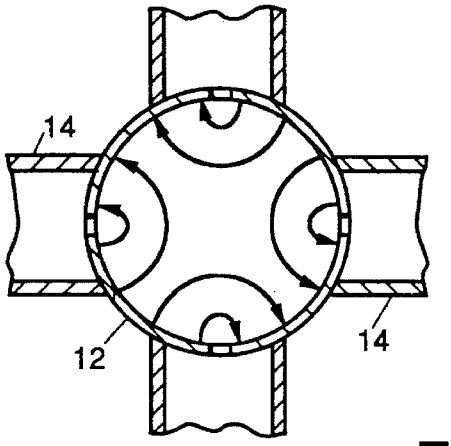
FIG. 4A is a representation of a first component of the $TE_{21}$ mode in the waveguide.
Figure 4B:
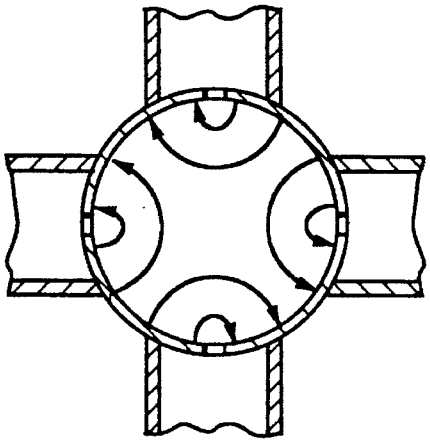
FIG. 4B is a representation of the component of the $TE_{21}$ mode in the waveguide in phase quadrature with the first component.

For example, consider one of the horizontal arms of FIG. 2B. If the phase shift of the coupled energy, as shown by the arrows 30-1, 30-2, were 90 instead of 180 degrees, it could not couple into the vertically polarized component of the $TE_{11}$ mode shown in FIG. 2B at all, since it would be in phase quadrature with it. However, the horizontal component of the circularly polarized wave shown in FIG. 3B is also in phase quadrature with the vertical component, and would therefore interact with the coupled energy, producing a beam deflection in the vertical plane. Thus, a 90 degree phase shift is associated with a 90 degree rotation of the deflection axis. Intermediate values of phase shift give corresponding intermediate rotations. Any relative orientation between the planes containing the arms and the planes of beam deflection can easily be obtained by adjusting the location of the diode with respect to the short-circuited termination of the arm. The corresponding $TE_{21}$ fields are depicted in FIGS. 4A and 4B. The $TE_{21}$ mode is invariant except for a sign change under a 90 degree rotation. The phase quadrature relationship remains, and can be envisioned in the same terms as applied to the $TE_{11}$ fields.

An electronic tracking antenna can also be constructed according to the present invention using only two opposing arms. If additional switching PIN diodes are installed in the two arms in such a position as to offer a 90 degree change in phase in the coupled energy, either of the quadrature fields, horizontal or vertical, can be selected. Therefore, two arms, containing multiple diodes can replace the four arms of the conventional feed.

In the four-arm feed, switching one diode results in a 180 degree change in phase across the aperture of the circular waveguide. Switching a single 90 degree diode would produce only half as much phase gradient and therefore would produce a smaller $TE_{21}$ field. This deficiency can be corrected by arranging to produce +90 degrees on one side and −90 degrees on the other. This is actually accomplished by increasing the length of one of the arms by one quarter wavelength, and switching the diodes on in pairs. One diode produces 90 degrees, and the other, in the longer of the two arms, produces 270 degrees, equivalent to −90 degrees. One beam position can be obtained with both diodes off, and the other when both are on.

Figure 5:
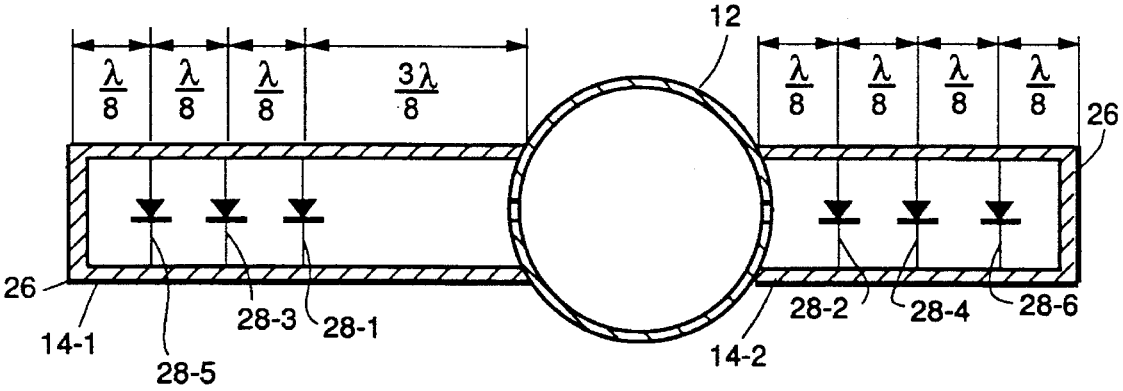
FIG. 5 is a view similar to that of FIG. 2B of a portion of a feed horn with only two mode switching arms.

FIG. 5 shows a preferred geometrical configuration of such a two arm feed. As in FIGS. 2A, 2B and 2C, the feed has a waveguide 12 and a pair of horizontal arms 14-1, 14-2, which preferably have electrically conducting end walls. There are no vertical arms as shown in the previous figures. The arms each contain a plurality, in this case six, of switchable shorting diodes 28-1 to 28-6 controlled in a manner well known in the art. The fundamental element of spacing between the diodes is one eighth wavelength everywhere except between the coupling hole 22 and the innermost left diode 28-1, where an additional quarter wavelength has been added. The wavelength used as the measuring unit is the wavelength of the $TE_{01}$ or $TE_{10}$ mode resonating in the rectangular arm.

TABLE 1 shows how a deflection of the $TE_{11}$ mode wavefront beam in any of four directions can be achieved by switching the diodes. Placing the diodes at other than quarter wavelength intervals provides deflections in other directions. A half wavelength can be added to either arm and any diode position without affecting the arm or the diode's operation.

TABLE I

| Diode Condition | Phase in Left Arm | Phase in Right Arm | Beam Deflection |
|---|---|---|---|
| 28-1, 28-2 on | 270° or −90° | 90° | Up |
| 28-3, 28-4 on | 0° | 180° | Left |
| 28-5, 28-6 on | 90° | 270° or −90° | Down |
| All diodes off | 180° | 0° | Right |
| 28-3 on | 0° | 0° | None |

In FIG. 5, the shorted terminations 26 of the arms are exploited in forming the beam deflection state of all diodes being off. The arms can alternatively be terminated in matching impedances instead of short circuits. This requires that a fourth diode be placed in each arm to achieve a deflection state with all other diodes off. Termination of the arm in a matched load means that the diodes do not have to deal with back leakage when in the on state. This may be an important consideration in some applications.

Figure 6:
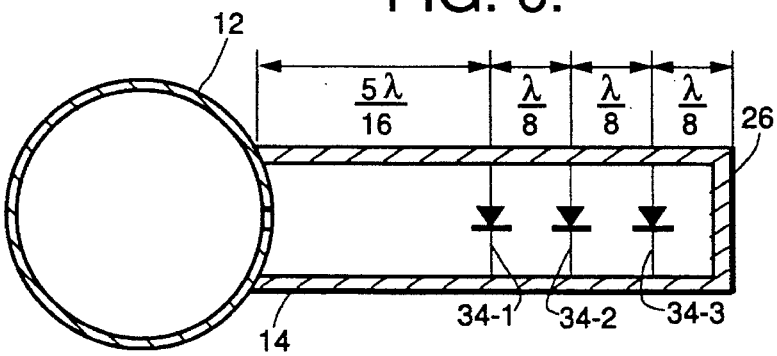
FIG. 6 is a view similar to that of FIG. 2B of a portion of a feed horn with only one mode switching arm.

It is also possible to produce a one-arm feed, in which a single arm contains either three or four switching diodes 34-1 to 34-3, as shown in FIG. 6. Again the fundamental spacing is one eighth wavelength except for the spacing between the coupling hole and the innermost diode 34-1, where a 5/16 wavelength spacing is used. This offset is preferred in order to achieve four independent beam directions. In this version of the one-arm feed, there is no undeflected beam position available, although this could be provided using a diode at the coupling hole or providing a diode at a ½ wavelength position. As in the two-arm feed of FIG. 5, it is possible to replace the short circuit termination end wall 26 with a fourth diode and terminate the arm waveguide with a matching load.

TABLE 2 shows how a deflection of the $TE_{11}$ mode wavefront beam can be achieved by switching the diodes. While the beam deflection directions are not the same as for the embodiments described above, they are all orthogonal to each other so that complete tracking information is obtained. Other deflection directions can be attained using different diode positions. There is no neutral or no deflection condition, however, this condition is rarely used in existing systems.

TABLE II

| Diode Condition | Phase In Arm | Beam Deflection |
|---|---|---|
| 34-1 on | 225° or −135° | Down-Right |
| 34-2 on | 315° or −45° | Down-Left |
| 34-3 on | 45° | Up-Left |
| All Off | 135° | Up-Right |

The beam deflections obtained with a one arm feed are not as great as with a two opposing arm feed such as those shown in FIG(s) 2A, 2B, 2C and 5. This requires more sensitive tracking detection circuitry but reduces disruption of the $TE_{11}$ mode data. Current tracking detection circuitry easily performs well enough to work with a one arm feed.

While the beam switching arms have been described as sections of rectangular waveguide, any generalized transmission lines with some sort of phase switching mechanism can be used. Depending on the frequency at which the feed is to operate, alternative waveguide types include Stripline, Microwave integrated circuits or Finline.

In some applications, the switching function can be performed with ferrite switches instead of PIN diodes. FIG. 7 shows a ferrite switch assembly having a circulator 36, two ferrite switches (reversible circulators) 38, 40, coupled to opposite sides of the circulator, two shorted waveguide stubs 42, 44 one coupled to each switch, and a waveguide interconnection section 46 interconnecting the two switches. The shorted stubs preferably add one eighth and one quarter wavelength respectively to the arm when switched on. This assembly is mounted on an opened end of a switching arm in either a two arm or a one arm feed such as those shown in FIG(s) 2A, 2B, 2C, 5 and 6.

FIG(s) 8A, 8B, 8C and 8D show how four different phase states can be generated by manipulating the two ferrite switches. The 0 degree state shown in FIG. 8A is a reference state only, since the transmission path through the device is of finite length. However, the length of the arm extending between the waveguide and the switch assembly can be adjusted to bring this reference value to zero at the coupling hole. In FIG. 8A both switches are off so that the switches act like the shorted ends of the arms shown, e.g. in FIG. 2B. In FIG. 8B, the left switch 38 connected to the eighth wavelength stub is switched open generating a 90° phase delay. The right switch is closed. In FIG. 8C, the right switch is open; and the left switch is closed generating a 180° phase delay through the quarter wavelength stub. In FIG. 8D both switches are open creating a waveguide through both stubs and the interconnection section for a 270° phase delay. The effects of these phase delays on beam direction are the same as those given in TABLE 1 for the same phase delays.

Figure 9:
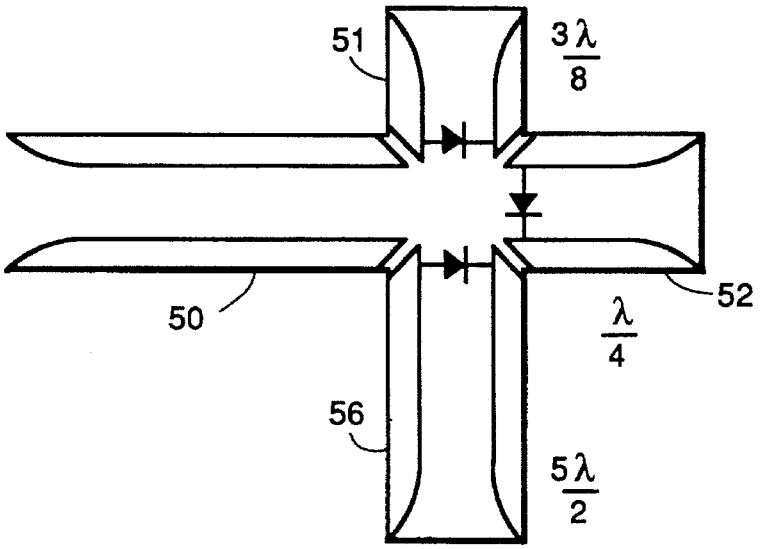
FIG. 9 is a diagram of an alternative three branch switching arm using Finline for use with a waveguide according to the present invention.

FIG(s) 9 and 10 show examples of Finline implementations of the switching function using branched fins. The switching arms have a main port 50 extending from the circular waveguide 12 (not shown), and, extending from the end of the port opposite the waveguide, a quarter wavelength fin 52, a three-eighths wavelength fin 54, a five-eighths wavelength fin 56, and a set of diodes 58, one extending between the waveguide and the opening for each fin. Each fin ends in a short circuit termination opposite the main port 50. FIG. 9 shows a three fin arm with each fin orthogonal to the neighboring fins or the neighboring fin on one side and the arm on the other. The switching arm in FIG. 10 has an additional diode switched half wavelength fin 58 orthogonal to the waveguide opposite the five eighths wavelength fin 56 which is also orthogonal to the waveguide. The other two fins extend opposite the waveguide between the half and five-eighths wavelength fins. The fins are electrically isolated from the outer waveguide structure and from adjacent segments to allow the application of bias voltages to the individual diodes. In the three-branch switching arm (FIG. 9) the zero phase reference is obtained with all diodes on.

For other phase states, a branch is selected by turning its particular diode off, allowing energy to propagate down the branch, be reflected at the short circuit termination and to return.

Figure 10:
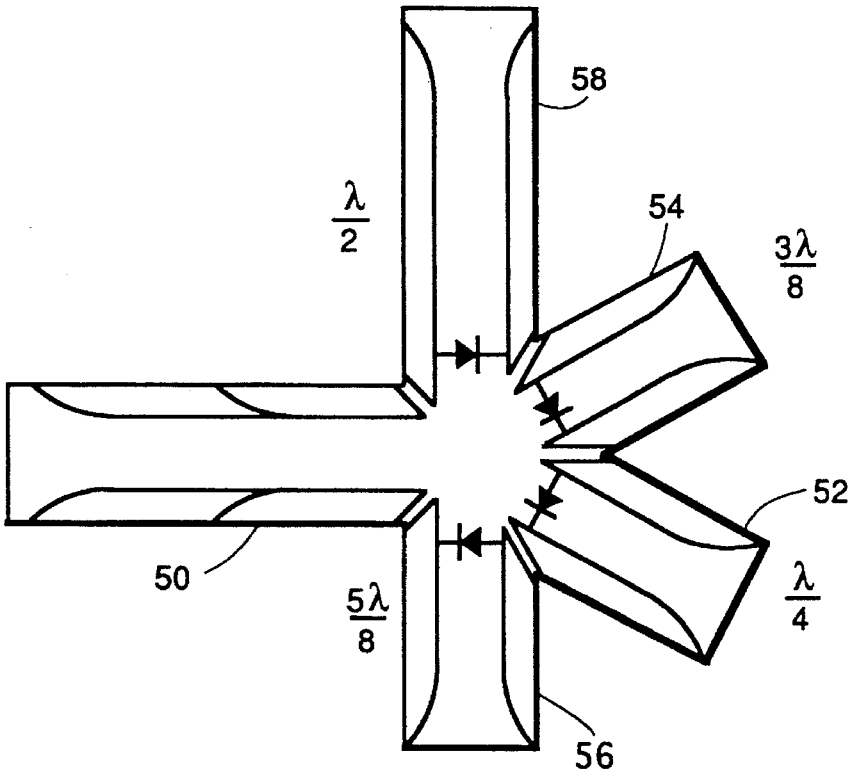
FIG. 10 is a diagram of an alternative four branch switching arm using Finline for use with a waveguide according to the present invention.

In the three-branch arm, the zero reference is electrically different from the other three states so an amplitude imbalance can occur. This is not true of the four-branch arm (FIG. 10). In the four branch arm, the zero reference is obtained by switching in a half-wavelength branch which effectively brings the short-circuited end to the position of the diode. The lengths of the other three branches are the same as those in the three-branch arm.

Either the three-branch or the four branch arm can be used to provide a one arm feed which is capable of an undeflected beam state should that be required. The length of the arm between the coupling hole and the shorting diodes is constructed to be an integral number of half wavelengths. Turning all diodes off therefore provides an undeflected beam state.

What is claimed is:

1. An antenna pointing detection system for use with circularly polarized electromagnetic radiation comprising:

a) a horn for receiving circularly polarized electromagnetic radiation in a primary mode from a source;

b) a waveguide coupled to the horn for receiving the received circularly polarized electromagnetic radiation from the horn, and that is dimensioned to support only radiation in the primary mode and the next order TE mode, and excluding the TM mode;

c) at least one mode switching arm extending from the waveguide for stimulating only radiation of the next order TE mode in the waveguide, the arm having a switchable plurality of different effective lengths for causing a phase alteration in said next order TE mode radiation to thereby cause a deflection of the effective pointing direction of the horn.

2. The antenna pointing detection system of claim 1 wherein the different effective lengths of the at least one mode switching arm are switchable to cause a deflection of the effective pointing direction of the horn in at least two orthogonal directions.

3. The antenna pointing detection system of claim 2 wherein the arms extend from the waveguide in substantially orthogonal directions with respect to each other and wherein said phase altered next order mode radiation combines with the primary mode radiation in the waveguide to deflect the effective pointing direction of the horn in at least two substantially orthogonal directions.

4. The antenna pointing detection system of claim 3 wherein the arms extend from the waveguide in substantially opposite directions with respect to each other.

5. The antenna pointing detection system of claim 1 comprising at least two mode switching arms extending from the waveguide for stimulating only radiation of the next order TE mode in the waveguide, each arm having a switchable plurality of different effective lengths for causing a phase alteration in said next order TE mode radiation in the waveguide, each arm thereby causing a deflection of the effective pointing direction of the horn in a different direction.

6. The antenna pointing detection system of claim 1 comprising at least two mode switching arms extending from the waveguide for stimulating only radiation of the next order TE mode in the waveguide, each arm having a switchable plurality of different effective lengths for causing a phase alteration in said next order TE mode radiation in the waveguide, the arms thereby cooperating to cause a deflection of the effective pointing direction of the horn in at least two opposite directions.

7. The antenna pointing detection system of claim 1 wherein the primary mode is the $TE_{11}$ mode.

8. The antenna pointing detection system of claim 1 wherein the next order TE mode is the $TE_{21}$ mode.

9. An antenna pointing detection system for use with circularly polarized electromagnetic radiation comprising:

a) a horn for receiving circularly polarized electromagnetic radiation in a primary mode from a source;

b) a waveguide coupled to the horn for receiving the received circularly polarized electromagnetic radiation from the horn;

c) a mode switching arm extending from the waveguide for stimulating radiation of only a single higher order TE mode in the waveguide, the arm having a switchable plurality of different effective lengths for causing a phase alteration in said higher order mode radiation, and excluding the TM mode;

d) wherein the phase altered higher order mode radiation combines with the primary mode radiation in the waveguide to deflect the effective pointing direction of the horn in at least two substantially orthogonal directions.

10. The antenna pointing detection system of claim 9 wherein the primary mode is the $TE_{11}$ mode.

11. The antenna pointing detection system of claim 9 wherein the higher order mode is the $TE_{21}$ mode.

12. The antenna pointing detection system of claim 9 wherein the waveguide is adapted to support only the primary and the higher order mode.

13. The antenna pointing detection system of claim 9 wherein the waveguide is cylindrical and the arm extends substantially orthogonally outwards from the cylindrical axis of the waveguide.

14. The antenna pointing detection system of claim 9 wherein the mode switching arm comprises a hollow waveguide.

15. The antenna pointing detection system of claim 14 wherein the arm comprises a plurality of diodes in its interior spaced along its length for changing the effective length of the arm.

16. The antenna pointing detection system of claim 15 wherein the diodes are spaced at one quarter wavelength intervals apart from each other within the hollow waveguide of the arm, the wavelength interval being based on the wavelength of the higher order mode radiation.

17. The antenna pointing detection system of claim 9 wherein the arm comprises a plurality of ferrite switches, each switch being coupled to a waveguide stub, for alternately connecting or isolating the respective coupled stub to the arm effectively changing the length of the arm.

18. The antenna pointing detection system of claim 9 further comprising a second mode switching arm extending from the waveguide opposite the first arm for stimulating radiation of the higher order mode in the waveguide and having a second switchable plurality of different effective lengths for causing a phase alteration in the higher mode radiation, the arms acting cooperatively to deflect the effective pointing direction of the horn in at least two substantially orthogonal directions.

19. The antenna pointing detection system of claim 9 further comprising a second mode switching ann extending from the waveguide orthogonal to the first arm for stimulating radiation of the higher order mode in the waveguide and having a second switchable plurality of different effective lengths for causing a phase alteration in the higher mode radiation, the arms acting cooperatively to deflect the effective pointing direction of the horn in at least two substantially orthogonal directions.

* * * * *